US012221962B2

(12) United States Patent
Wood

(10) Patent No.: US 12,221,962 B2
(45) **Date of Patent: *Feb. 11, 2025**

(54) SCROLL COMPRESSOR WITH CIRCULAR SURFACE TERMINATIONS

(71) Applicant: Mark W. Wood, Cedar Grove, TN (US)

(72) Inventor: Mark W. Wood, Cedar Grove, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/315,004

(22) Filed: May 10, 2023

(65) Prior Publication Data

US 2024/0044334 A1 Feb. 8, 2024

Related U.S. Application Data

(63) Continuation of application No. 17/751,575, filed on May 23, 2022, now Pat. No. 11,686,309, which is a (Continued)

(51) Int. Cl.
*F04C 18/00* (2006.01)
*F04C 2/04* (2006.01)

(Continued)

(52) U.S. Cl.
CPC ..... *F04C 27/006* (2013.01); *F04C 2/04* (2013.01); *F04C 18/0215* (2013.01);

(Continued)

(58) Field of Classification Search
CPC .... F04C 2/04; F04C 18/0215; F04C 18/0246; F04C 18/0261; F04C 18/0269;

(Continued)

(56) References Cited

U.S. PATENT DOCUMENTS 1,872,361 A 8/1932 John et al.
2,545,238 A 3/1951 Macmillin et al.

(Continued)

FOREIGN PATENT DOCUMENTS

EP 1233186 A2 8/2002
EP 1233186 B1 9/2004

(Continued)

OTHER PUBLICATIONS

International Search Report and Written Opinion mailed May 30, 2017 for PCT/US2017/020162.

(Continued)

*Primary Examiner* — Theresa Trieu
(74) *Attorney, Agent, or Firm* — Kevin E. West; Advent, LLP

(57) ABSTRACT

A scroll type positive displacement assembly includes a first scroll and a second scroll, where the second scroll is configured to orbit with respect to a center of the first scroll without rotating with respect to the first scroll. Together, the first scroll and the second scroll define a compression chamber between two seal points where the first scroll and the second scroll contact one another as the second scroll orbits with respect to the first scroll during a compression cycle, and the two seal points come together proximate to a discharge port between the first scroll and the second scroll such that there is at least substantially no dead space between the first scroll and the second scroll at an end of the compression cycle. For example, the two seal points remain in sealing contact during at least one hundred and eighty (180) degrees of the compression cycle.

20 Claims, 13 Drawing Sheets

Related U.S. Application Data continuation of application No. 16/348,059, filed as application No. PCT/US2016/060807 on Nov. 7, 2016, now Pat. No. 11,339,786.

(51) Int. Cl.

| | |
|---|---|
| ***F04C 18/02*** | (2006.01) |
| ***F04C 27/00*** | (2006.01) |
| ***F04C 29/12*** | (2006.01) |
| *F04C 23/00* | (2006.01) |

(52) U.S. Cl.
CPC ..... *F04C 18/0269* (2013.01); *F04C 29/12* (2013.01); *F04C 23/008* (2013.01)

(58) Field of Classification Search
CPC .... F04C 23/008; F04C 27/006; F04C 27/007; F04C 29/12
See application file for complete search history.

(56) References Cited

U.S. PATENT DOCUMENTS

| | | | | |
|---|---|---|---|---|
| 2,966,898 | A | 1/1961 | Joseph et al. | |
| 3,125,031 | A | 3/1964 | Rydberg et al. | |
| 3,195,470 | A | 7/1965 | Smith | |
| 3,410,478 | A | 11/1968 | Geisenhaver | |
| 4,568,253 | A | 2/1986 | Wood | |
| 4,629,403 | A | 12/1986 | Wood | |
| 4,781,549 | A | 11/1988 | Caillat | |
| 5,169,299 | A | 12/1992 | Gannaway | |
| 5,222,885 | A | 6/1993 | Cooksey | |
| 5,364,247 | A * | 11/1994 | Fukanuma | F04C 18/0269 418/142 |
| 5,399,076 | A | 3/1995 | Matsuda et al. | |
| 5,501,584 | A | 3/1996 | Yamamoto et al. | |
| 6,607,371 | B1 | 8/2003 | Raymond et al. | |
| 6,746,223 | B2 | 6/2004 | Manole | |
| 7,179,067 | B2 | 2/2007 | Bush et al. | |
| 7,341,437 | B2 | 3/2008 | Hwang et al. | |
| 7,367,790 | B2 | 5/2008 | Hwang et al. | |
| 8,517,702 | B2 | 8/2013 | Byun et al. | |
| RE46,106 | E | 8/2016 | Seong et al. | |
| 10,030,658 | B2 | 7/2018 | Wood | |
| 11,022,118 | B2 | 6/2021 | Wood | |
| 11,339,786 | B2 * | 5/2022 | Wood | F04C 27/006 |
| 11,480,178 | B2 | 10/2022 | Wood | |
| 11,686,309 | B2 * | 6/2023 | Wood | F04C 27/006 418/104 |
| 2001/0018028 | A1 | 8/2001 | Kikuchi et al. | |
| 2002/0102171 | A1 | 8/2002 | Jurgen et al. | |
| 2006/0056988 | A1 | 3/2006 | Seok et al. | |
| 2006/0073055 | A1 | 4/2006 | Hwang et al. | |
| 2006/0210415 | A1 | 9/2006 | Ohtake | |
| 2009/0013714 | A1 | 1/2009 | Yamaguchi et al. | |
| 2010/0119378 | A1 | 5/2010 | Shibamoto et al. | |
| 2011/0165007 | A1 | 7/2011 | Pekrul | |
| 2013/0011290 | A1 | 1/2013 | Okamoto et al. | |
| 2020/0173438 | A1 | 6/2020 | Wood | |

FOREIGN PATENT DOCUMENTS

| | | | |
|---|---|---|---|
| GB | 2234787 | A | 2/1991 |
| JP | 2005273453 | A | 10/2005 |
| JP | 2008116153 | A | 5/2008 |
| KR | 20100084079 | A | 7/2010 |
| WO | 2015147744 | A1 | 10/2015 |

OTHER PUBLICATIONS

International Preliminary Report on Patentability for PCT/US2017/020162, dated Oct. 30, 2018.
International Search Report and Written Opinion for Application No. PCT/US2016/060807, dated Jul. 25, 2017.
Lee, Jeong-Bae, et al., "Development of a Miniature Twin Rotary Compressor," 22nd International CompressorEngineering Conference at Purdue, Jul. 14-17, 2014 http://docs.lib .purdue.edu/cgi/viewcontent.cgi?article=3316context=icec).
PCT International Search Report and Written Opinion for PCT/US2021/016412, dated May 6, 2021.

* cited by examiner

*0° SHAFT ROTATION*

*90° SHAFT ROTATION*

*180° SHAFT ROTATION*

*270° SHAFT ROTATION*

SCROLL COMPRESSOR WITH CIRCULAR SURFACE TERMINATIONS

BACKGROUND

Scroll type positive displacement compressors and pumps include spiral wraps (scrolls) for compressing or pumping a fluid or gas, such as for refrigeration and other applications. Typically, a scroll type compressor or pump includes a stationary scroll, an orbiting scroll, an anti-rotation device (e.g., an Oldham ring) to prevent rotation of the orbiting scroll and bearings, a crankshaft, and an eccentrically mounted shaft. Generally, the scroll shape consists of a spiral wall with a radius increasing in proportion to the wrap angle. The scroll walls begin adjacent to a discharge port near the center of the scroll plate to minimize dead space, maximize compression ratio, and provide a flow path to the discharge port.

SUMMARY

A scroll type positive displacement assembly includes a first scroll and a second scroll, where the second scroll is configured to orbit with respect to a center of the first scroll without rotating with respect to the first scroll. Together, the first scroll and the second scroll define a compression chamber between two seal points where the first scroll and the second scroll contact one another as the second scroll orbits with respect to the first scroll during a compression cycle, and the two seal points come together proximate to a discharge port between the first scroll and the second scroll such that there is at least substantially no dead space between the first scroll and the second scroll at an end of the compression cycle. For example, the two seal points remain in sealing contact during at least one hundred and eighty (180) degrees of the compression cycle.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
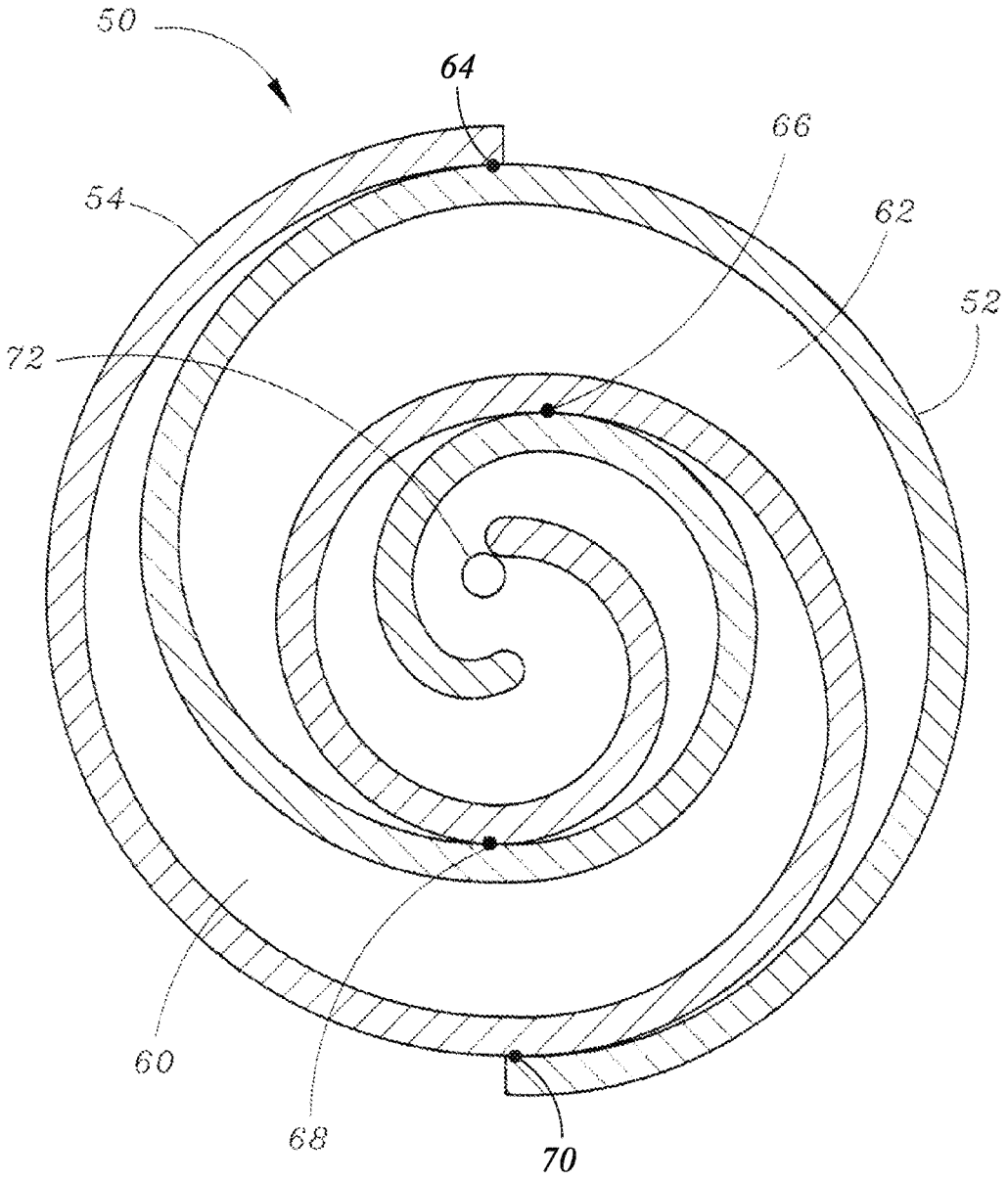
FIG. 1 (PRIOR ART)
FIG. 1 is a partial cross-sectional plan view illustrating a conventional scroll type positive displacement assembly including a fixed scroll member and an orbiting scroll member at zero (0) degrees of shaft rotation.
Figure 2:
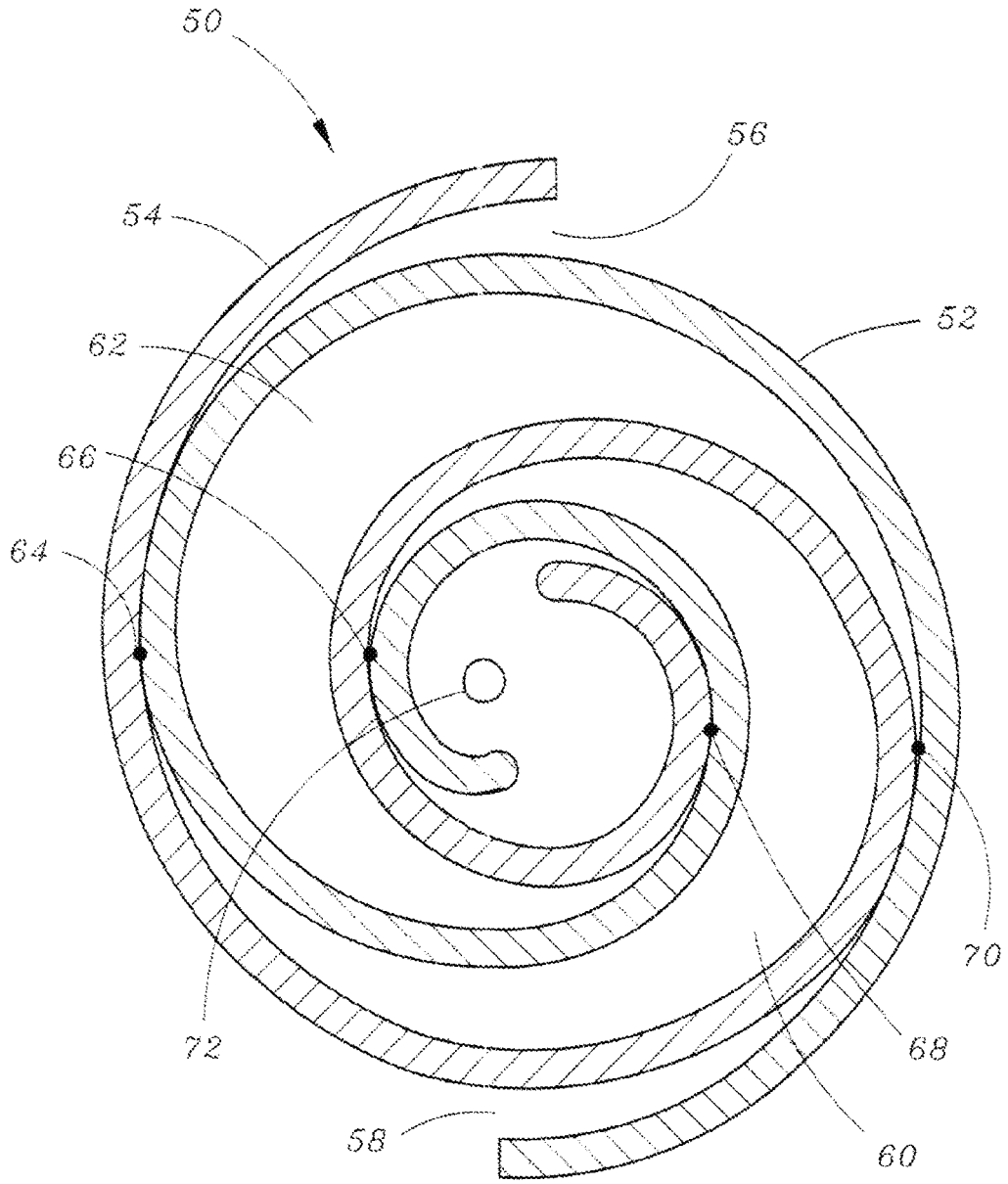
FIG. 2 (PRIOR ART)
FIG. 2 is a partial cross-sectional plan view of the conventional scroll type positive displacement assembly illustrated in FIG. 1, wherein the orbiting scroll member is shown orientated at ninety (90) degrees of shaft rotation.
Figure 3:
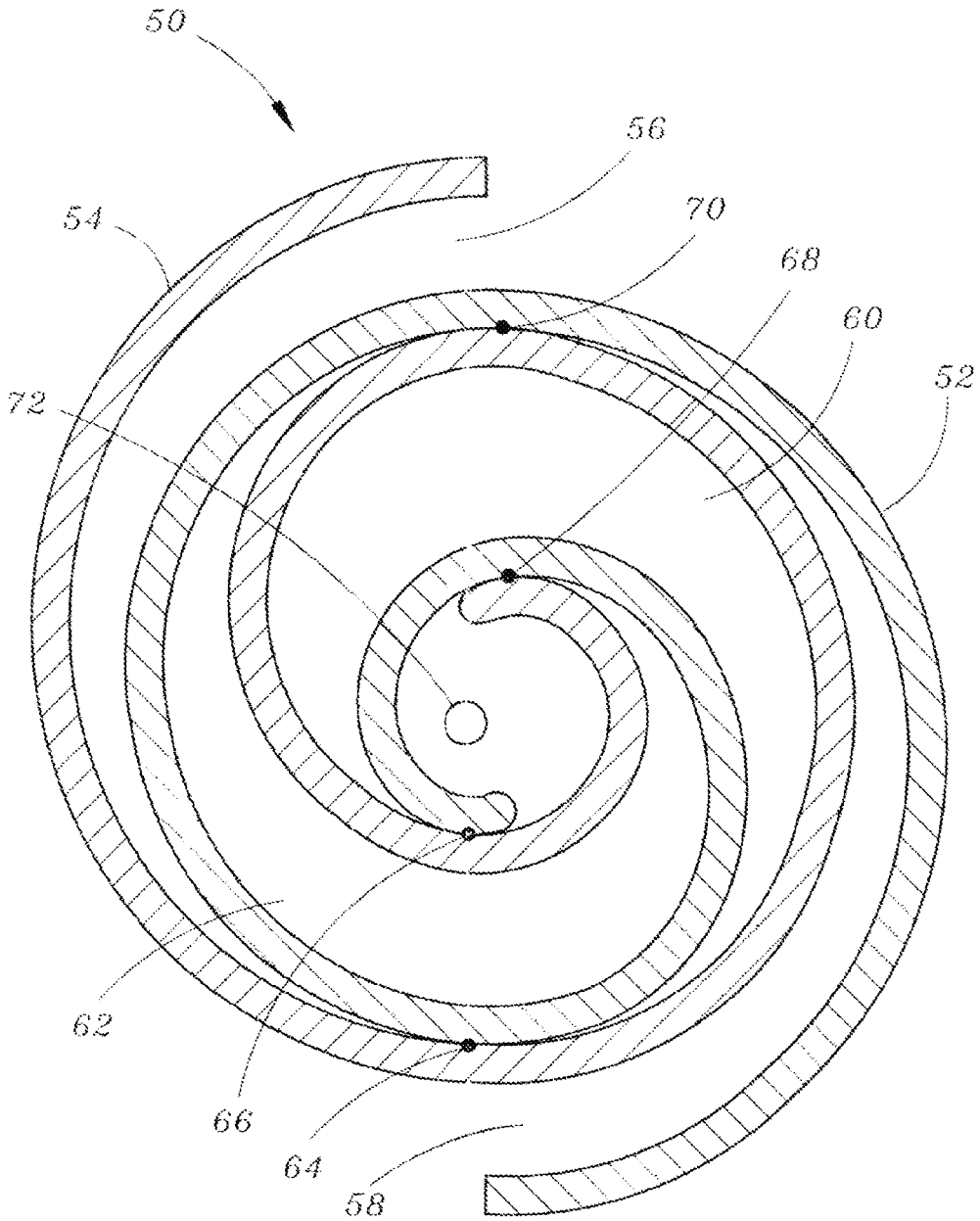
FIG. 3 (PRIOR ART)
FIG. 3 is a partial cross-sectional plan view of the conventional scroll type positive displacement assembly illustrated in FIG. 1, wherein the orbiting scroll member is shown orientated at one hundred and eighty (180) degrees of shaft rotation.

Referring to FIGS. 1 through 4, a conventional scroll type positive displacement assembly 50 is described. The scroll type positive displacement assembly 50 includes a fixed scroll 52 and an orbiting scroll 54. The orbiting scroll 54 orbits about the center of the fixed scroll 52 without rotating. For instance, an anti-rotation device, such as an Oldham ring, is employed to prevent rotation of the orbiting scroll.

A fluid or gas (e.g., air, refrigerant, or the like) is introduced between the fixed and orbiting scrolls 52 and 54, i.e., at the outer periphery of the two scrolls. As shown, the fluid or gas is introduced between the fixed scroll 52 and the orbiting scroll 54 at a first intake cavity 56 and a second intake cavity 58. As the orbiting scroll 54 orbits about the center of the fixed scroll 52, the fluid or gas introduced at the first intake cavity 56 is contained within a first compression chamber 60 formed between the two scrolls, while the fluid or gas introduced at the second intake cavity 58 is contained within a second compression chamber 62.

Figure 4:
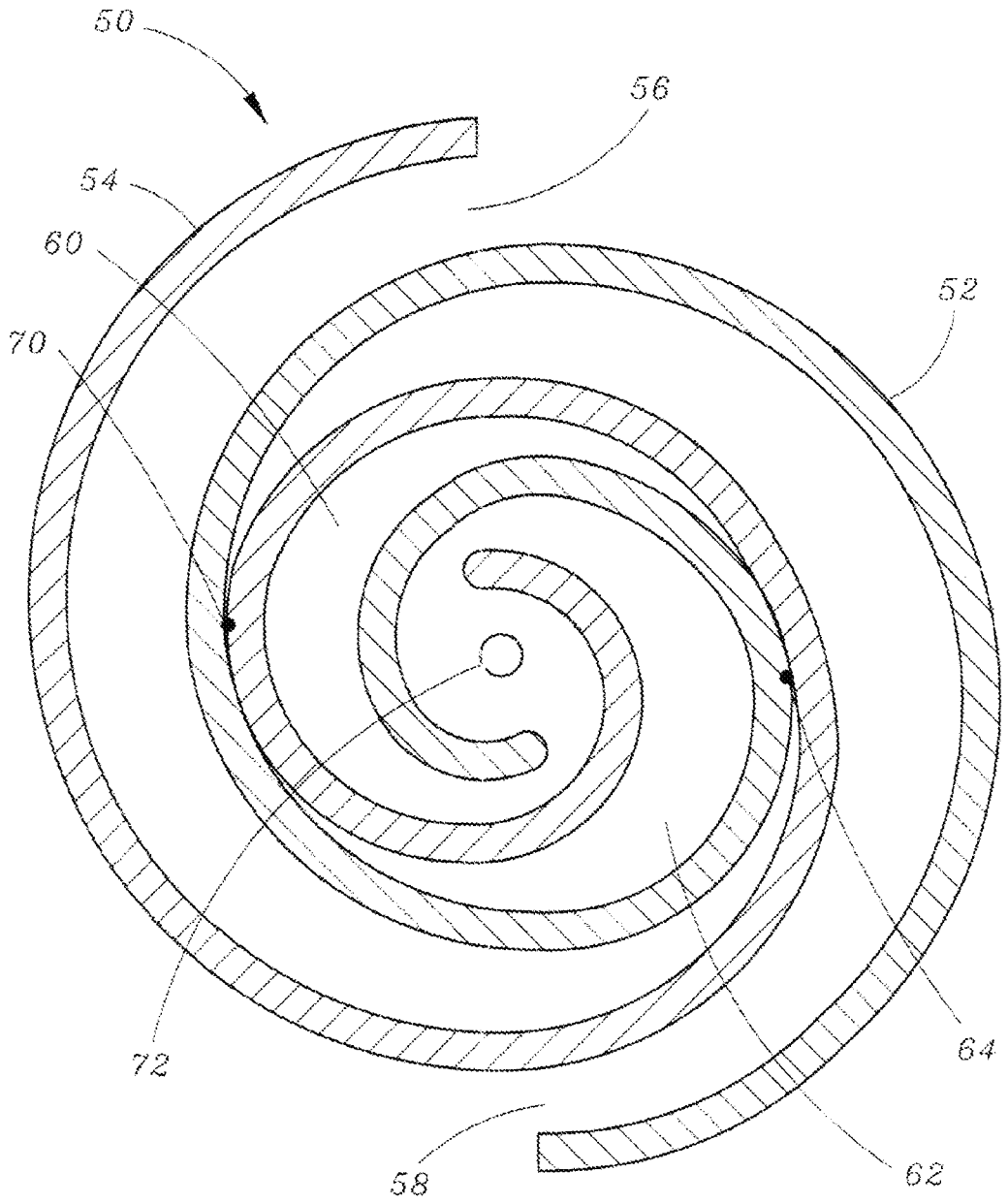
FIG. 4 (PRIOR ART)
FIG. 4 is a partial cross-sectional plan view of the conventional scroll type positive displacement assembly illustrated in FIG. 1, wherein the orbiting scroll member is shown orientated at two hundred and seventy (270) degrees of shaft rotation.
Figure 5:
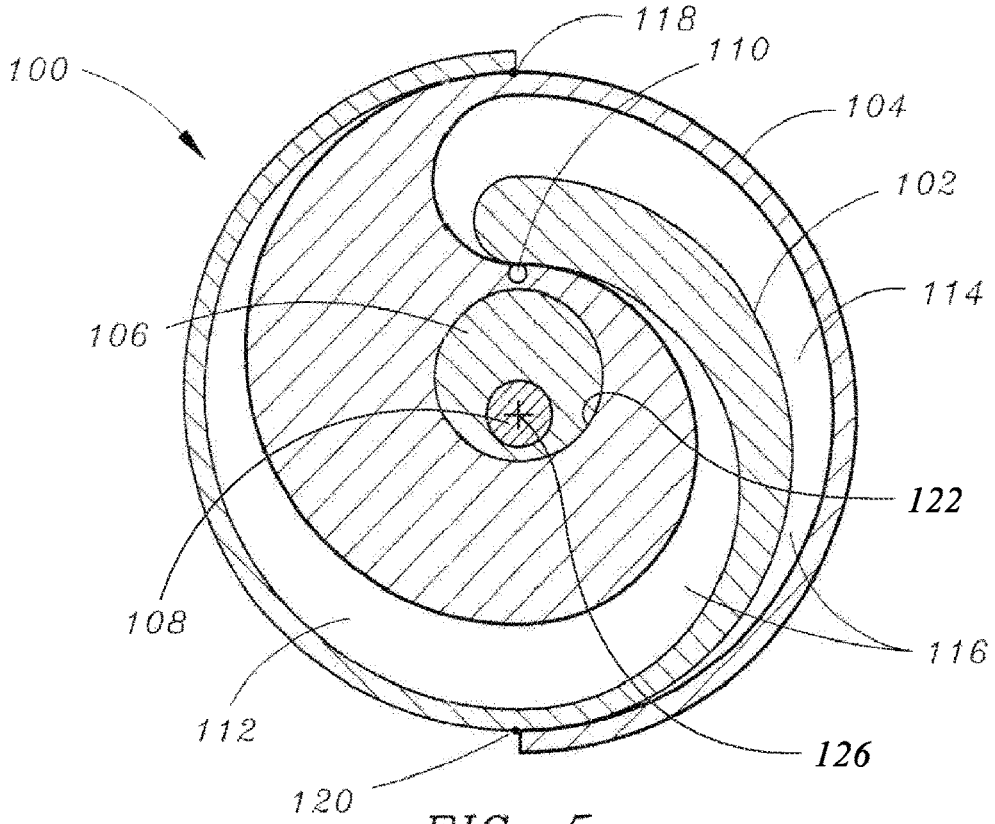
FIG. 5 is a partial cross-sectional plan view illustrating a scroll type positive displacement assembly including a fixed scroll member and an orbiting scroll member, in accordance with an example embodiment of the present disclosure.
Figure 6:
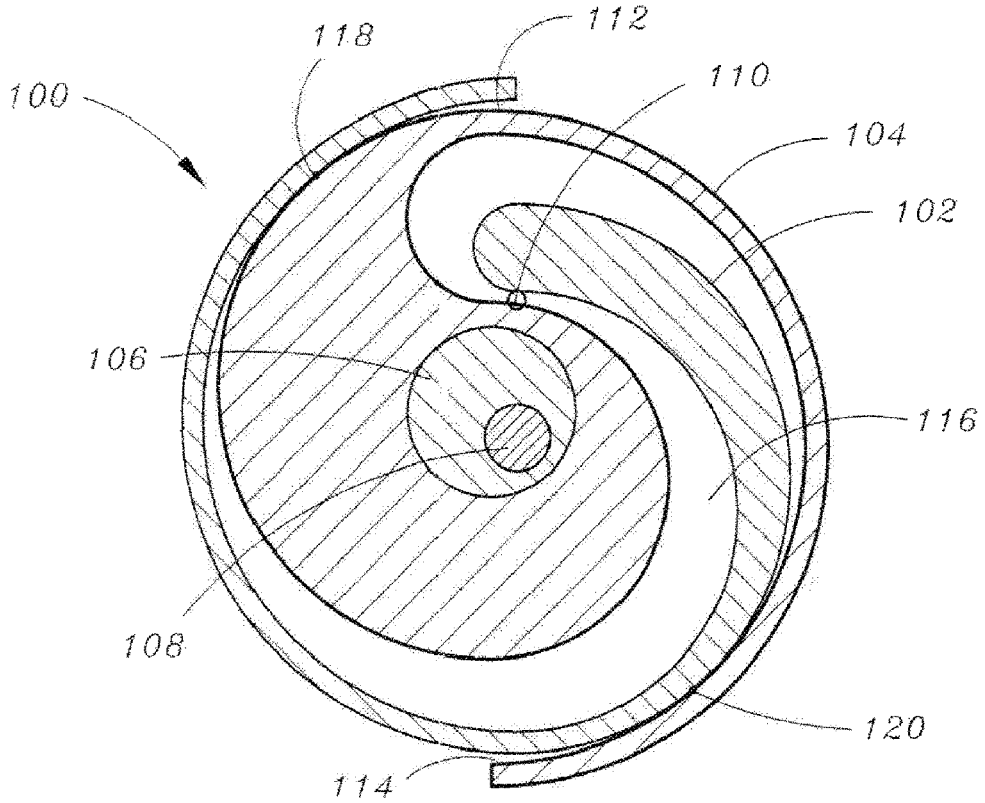
FIG. 6 is a partial cross-sectional plan view of the scroll type positive displacement assembly illustrated in FIG. 5, wherein the orbiting scroll member is shown orientated at forty-five (45) degrees of shaft rotation.
Figure 7:
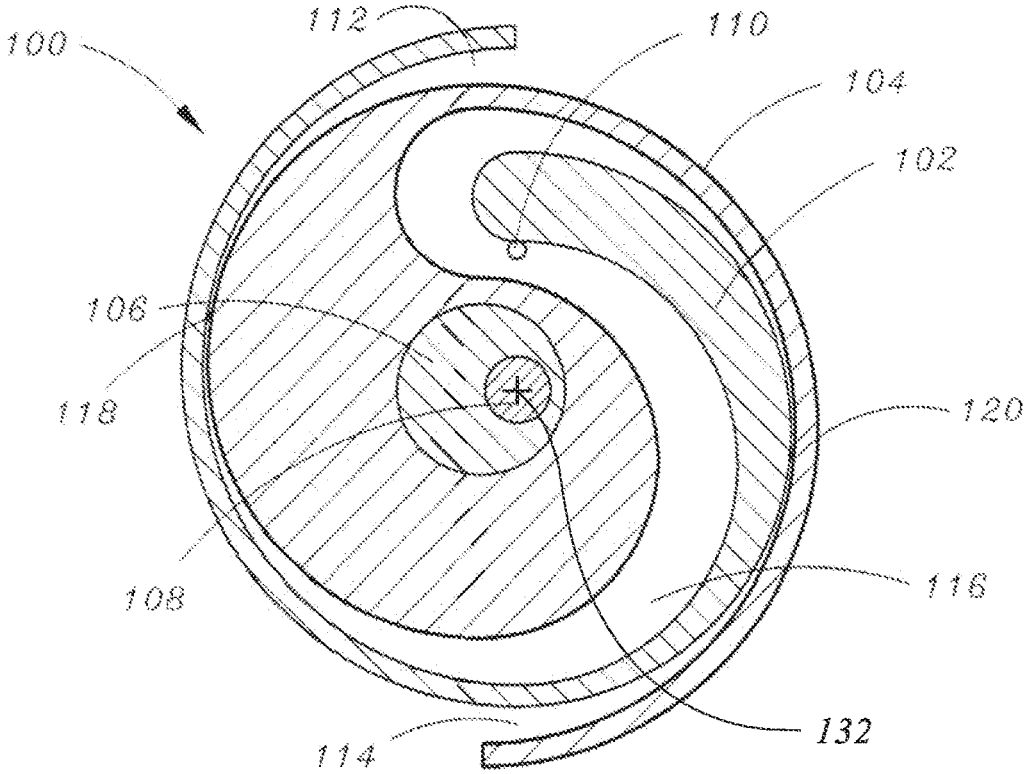
FIG. 7 is a partial cross-sectional plan view of the scroll type positive displacement assembly illustrated in FIG. 5, wherein the orbiting scroll member is shown orientated at ninety (90) degrees of shaft rotation.
Figure 8:
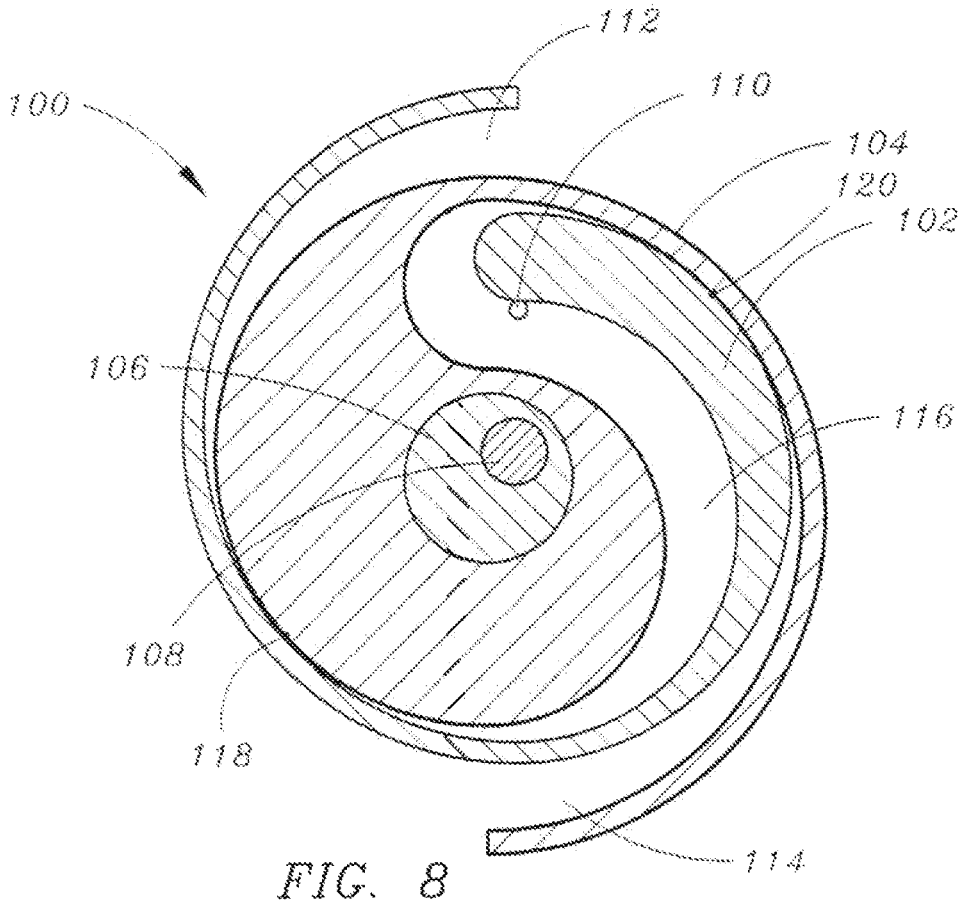
FIG. 8 is a partial cross-sectional plan view of the scroll type positive displacement assembly illustrated in FIG. 5, wherein the orbiting scroll member is shown orientated at one hundred and thirty-five (135) degrees of shaft rotation.
Figure 9:
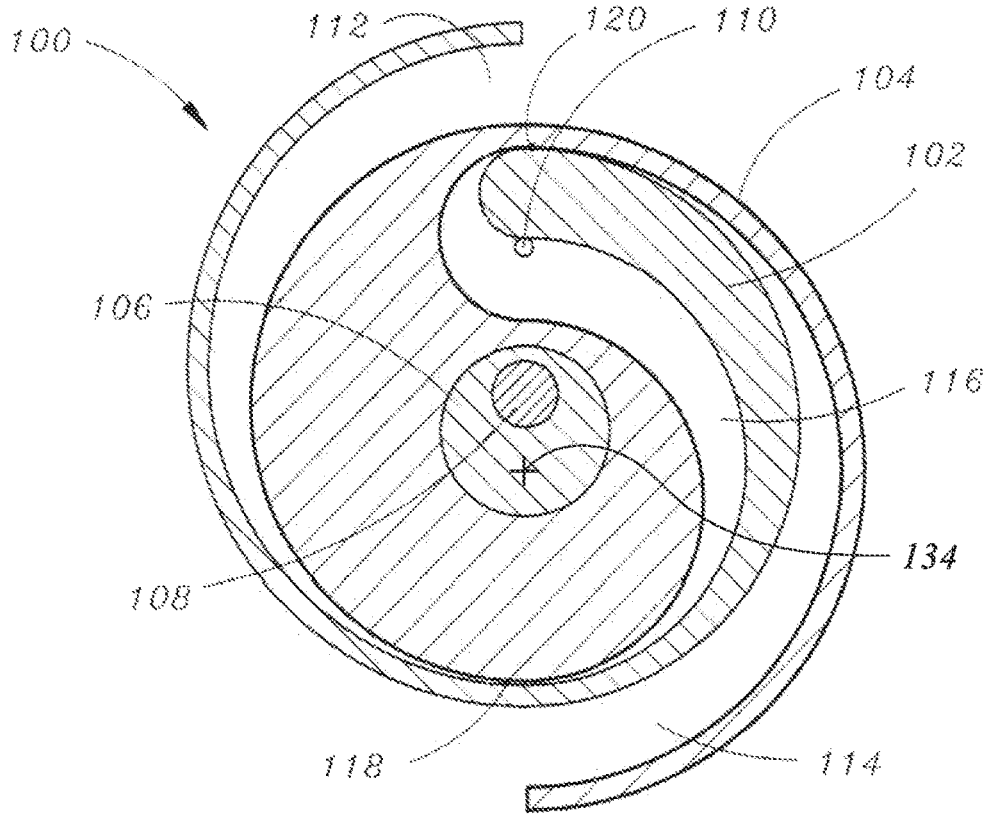
FIG. 9 is a partial cross-sectional plan view of the scroll type positive displacement assembly illustrated in FIG. 5, wherein the orbiting scroll member is shown orientated at one hundred and eighty (180) degrees of shaft rotation.
Figure 10:
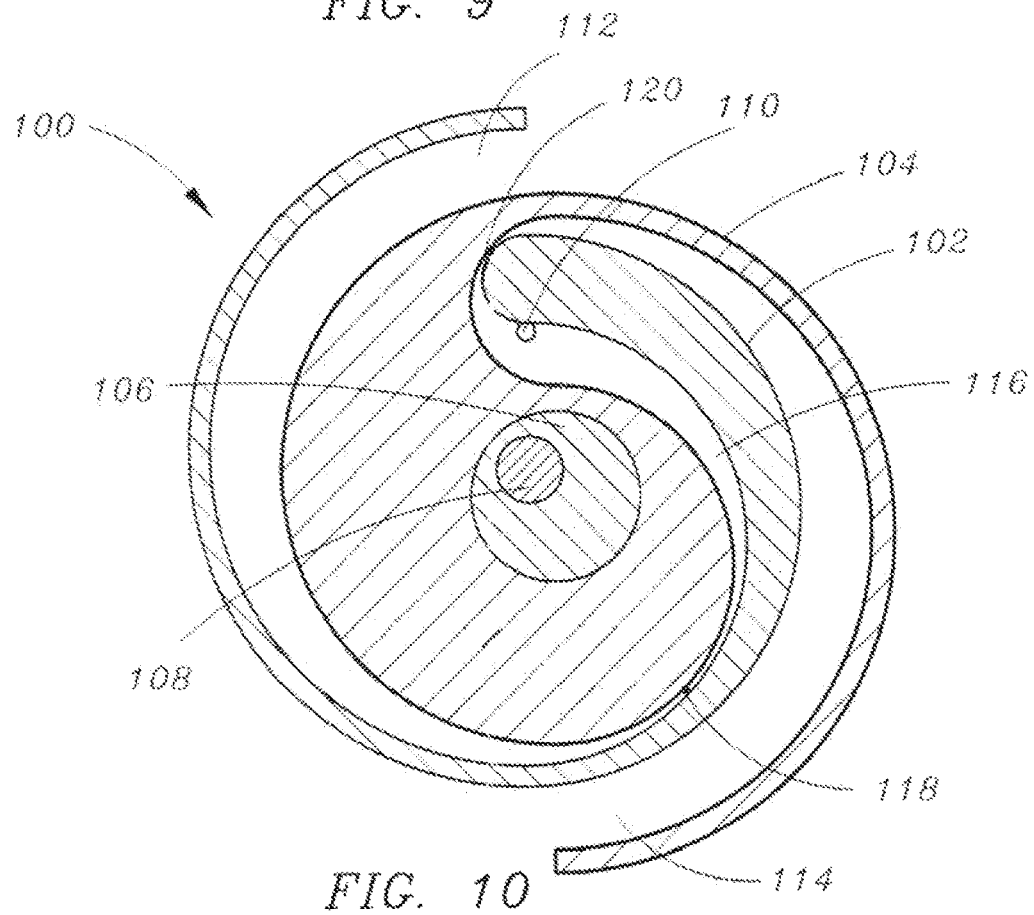
FIG. 10 is a partial cross-sectional plan view of the scroll type positive displacement assembly illustrated in FIG. 5, wherein the orbiting scroll member is shown orientated at two hundred and twenty-five (225) degrees of shaft rotation.
Figure 11:
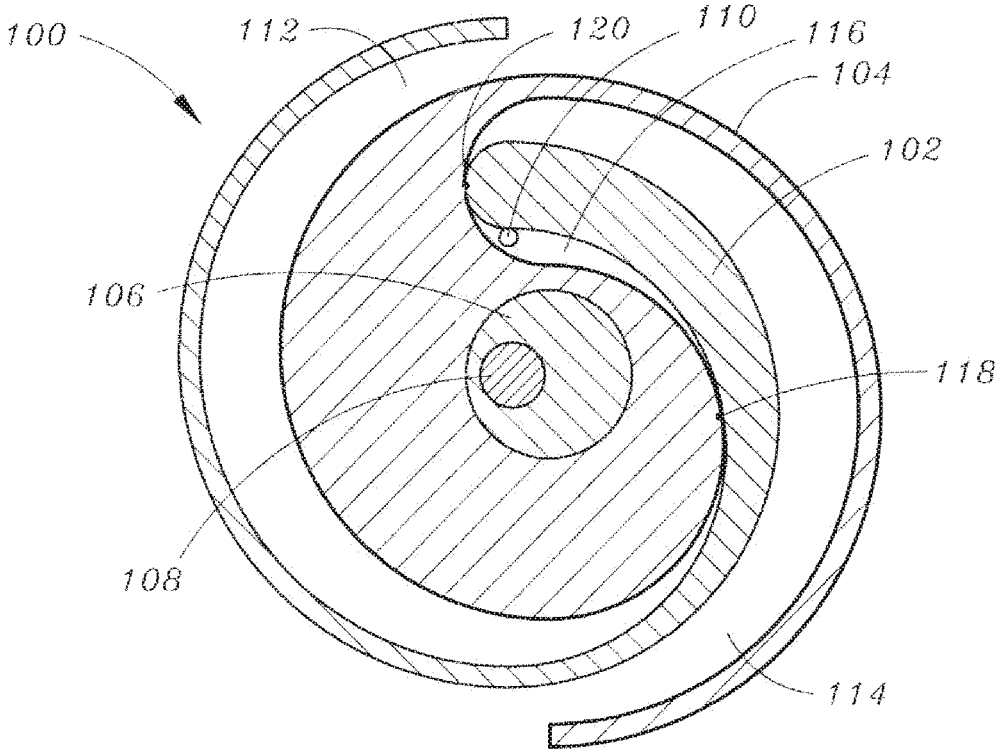
FIG. 11 is a partial cross-sectional plan view of the scroll type positive displacement assembly illustrated in FIG. 5, wherein the orbiting scroll member is shown orientated at two hundred and seventy (270) degrees of shaft rotation.
Figure 12:
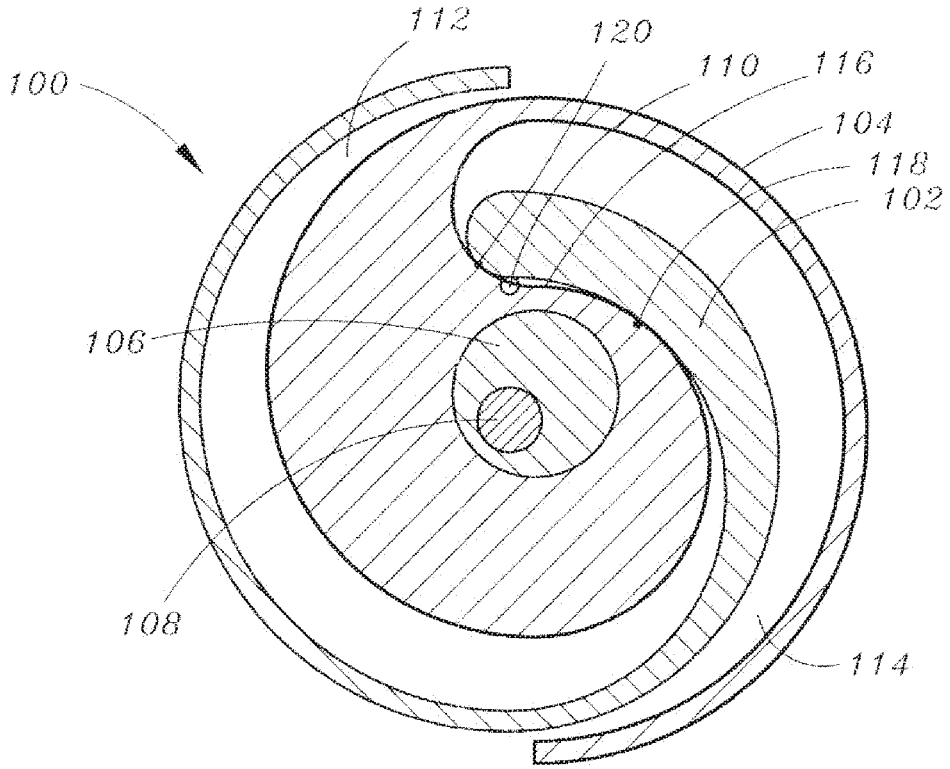
FIG. 12 is a partial cross-sectional plan view of the scroll type positive displacement assembly illustrated in FIG. 5, wherein the orbiting scroll member is shown orientated at three hundred and fifteen (315) degrees of shaft rotation.

The first compression chamber 60 is formed between a first seal point 64 and a second seal point 66, positioned at first and second locations where the fixed scroll 52 contacts the orbiting scroll 54. The second compression chamber 62 is formed between a third seal point 68 and a fourth seal point 70, positioned at third and fourth locations where the fixed scroll 52 contacts the orbiting scroll 54. As the orbiting scroll 54 continues to orbit about the center of the fixed scroll 52, the fluid or gas contained within the first and second compression chambers 60 and 62 migrates toward a discharge port 72. The fluid or gas is then expelled via the discharge port 72. As shown in FIG. 4, the conventional scroll type positive displacement assembly 50 experiences seal separation of the second seal point 66 and the third seal point 68 during the last one hundred and eighty (180) degrees of the compression cycle.

In such a configuration, the compressor shaft is cantilevered because there is no room to pass the shaft and eccentric through the center of the scroll. Thus, the plane of the eccentric bearing is axially offset from the plane of the scrolls, inducing a moment on the orbiting scroll causing additional non-symmetric axial thrust between the scrolls. The cantilevered shaft also causes increased radial shaft and bearing loading which requires a larger shaft and bearings and reduces mechanical efficiency. To compensate for axial thrust on the orbiting scroll, a thrust bearing system is incorporated.

Figure 17:
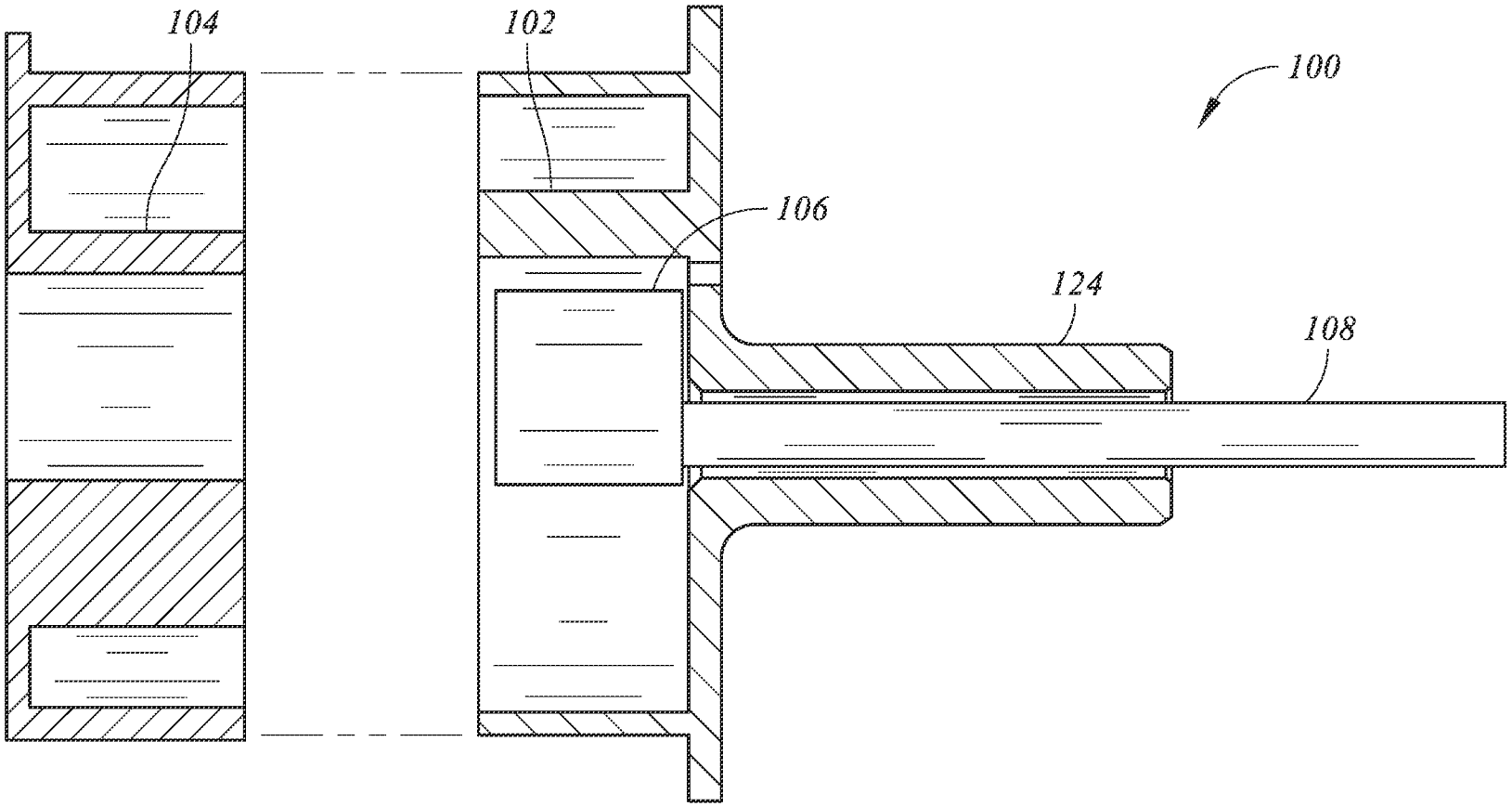
FIG. 17 is a partial cross-sectional exploded side elevation view illustrating a scroll type positive displacement assembly including an orbiting scroll, a stationary scroll, an eccentric, and a non-through shaft in accordance with an example embodiment of the present disclosure.
Figure 18:
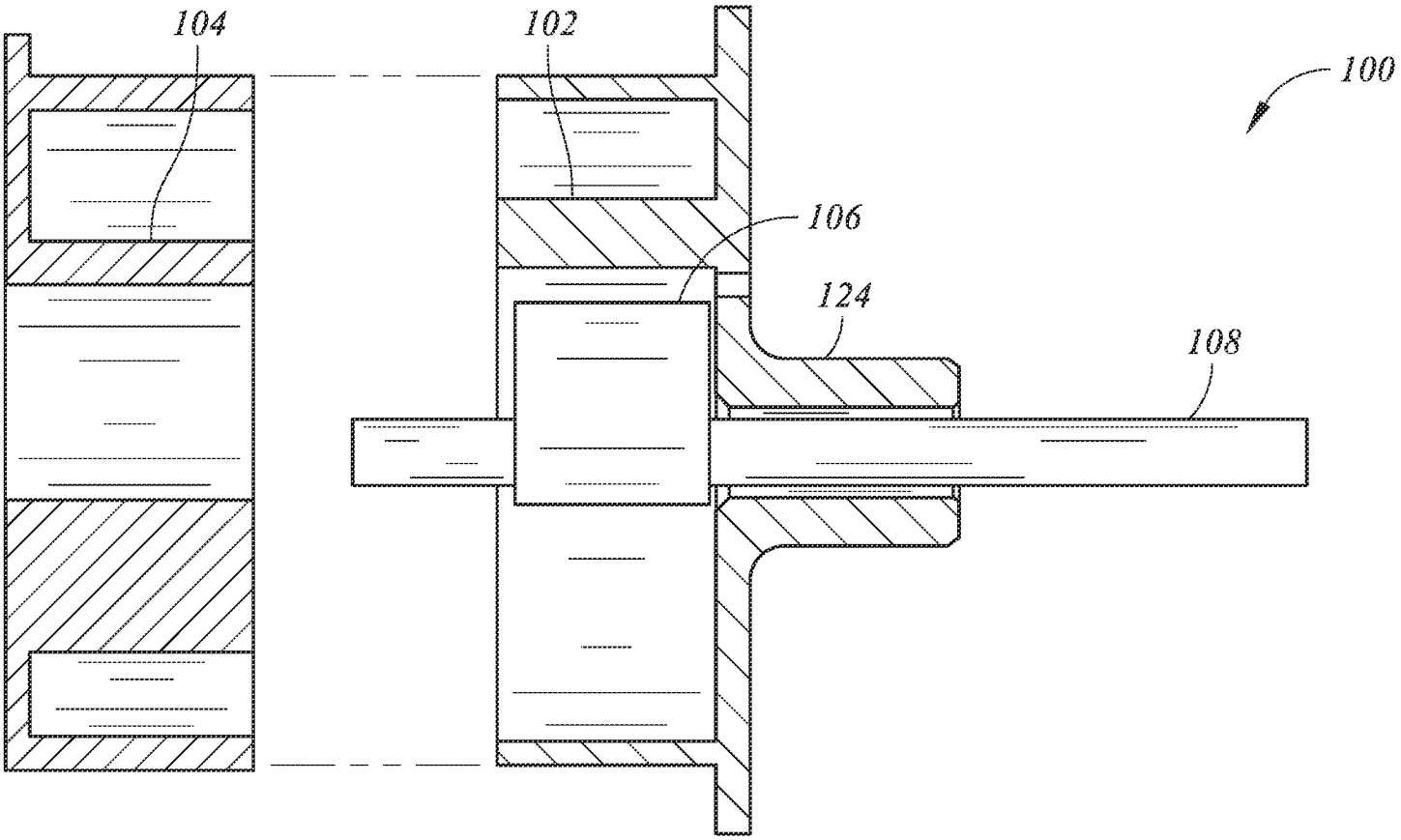
FIG. 18 is a partial cross-sectional exploded side elevation view illustrating a scroll type positive displacement assembly including an orbiting scroll, a stationary scroll, an eccentric, and a through shaft in accordance with an example embodiment of the present disclosure.

Referring now to FIGS. 5 through 18, a scroll type positive displacement assembly 100 is described in accordance with example embodiments of the present disclosure. As described herein, the scroll type positive displacement assembly may be a positive displacement device for compressing or pumping a fluid or gas that allows room for an eccentric, eccentric bearing, shaft and shaft bearings, with the shaft passing through the scrolls and the eccentric. The eccentric and eccentric bearing may be axially located in the plane of the scroll surfaces. In some embodiments, a scroll type positive displacement assembly 100 may include a non-through shaft supported by a shaft bearing on one side of an eccentric (e.g., as described with reference to FIG. 17). In other embodiments, a scroll type positive displacement assembly 100 may include a through shaft that can be supported by shaft bearings on each side of the eccentric (e.g., as described with reference to FIG. 18). The scroll type positive displacement assembly can include a fixed scroll and an orbiting scroll. The orbiting scroll orbits about the center of the fixed scroll without rotating. The eccentric, eccentric bearing, shaft, and shaft bearings can be used for orbiting the orbiting scroll about the center of the fixed scroll, while an anti-rotation device prevents rotation of the orbiting scroll. For instance, the scroll type positive displacement assembly 100 includes a fixed scroll 102 and an orbiting scroll 104. The orbiting scroll 104 orbits about the center of the fixed scroll 102 without rotating. In embodiments, an eccentric 106, an eccentric bearing 122, a shaft 108, and shaft bearings 124 are used for orbiting the orbiting scroll 104 about the center of the fixed scroll 102, while an anti-rotation device prevents rotation of the orbiting scroll 104. For example, an anti-rotation device such as an Oldham ring may be employed to prevent rotation of the orbiting scroll. A fluid or gas (e.g., air, refrigerant, or the like) can be introduced between the fixed and orbiting scrolls 102 and 104, i.e., at the outer periphery of the two scrolls.

In the embodiment illustrated in FIGS. 5 through 12, fluid or gas is introduced between the fixed scroll 102 and the orbiting scroll 104 at a first intake cavity 112 and a second intake cavity 114. As the orbiting scroll 104 orbits about the center of the fixed scroll 102, the fluid or gas is contained within a compression chamber 116 formed between the two scrolls. The compression chamber 116 is formed between a first seal point 118 and a second seal point 120, and the first and second seal points 118 and 120 are positioned where the fixed scroll 102 contacts the orbiting scroll 104. As the orbiting scroll 104 continues to orbit about the center of the fixed scroll 102, the fluid or gas contained within the compression chamber 116 migrates toward a discharge port 110. In embodiments, the discharge port 110 is offset from a center 126 of the scroll type positive displacement assembly 100. The fluid or gas is then expelled from the scroll type positive displacement assembly 100 via the discharge port 110, where the first and second seal points 118 and 120 come together. The two seal points 118 and 120 each continuously travel along a curved path while the fixed scroll 102 and the orbiting scroll 104 are in contact with one another and come together over the discharge port 110 between the fixed scroll 102 and the orbiting scroll 104 such that the compression chamber 116 continuously decreases in volume while the fixed scroll 102 and the orbiting scroll 104 are in contact with one another until the two seal points 118 and 120 come together at an end of the compression cycle.

One feature of the scroll type positive displacement assembly 100 of the present disclosure is that the first one hundred and eighty (180) degrees of compression cavity, beginning at the discharge port area and moving outward, which is formed during the last one hundred and eighty (180) degrees of the compression cycle, is defined by four constant radius one hundred and eighty (180) degree arcs, two inside surfaces on the fixed scroll 102 and two outside surfaces on the orbiting scroll 104. A series of mathematical equations can be used to define the relationships between the scroll geometry and the four radii and their locations. These relationships may ensure that the correct sequence of sealing contact is maintained between the fixed and orbiting scrolls in the compression cavities, and that the compression cavity has no dead space at the end of the compression cycle except for the space remaining in the discharge port 110 and passages. These equations are listed and explained below. The remaining scroll surfaces, beyond the first one hundred and eighty (180) degrees, may be defined by conventional scroll equations.

Figure 14:
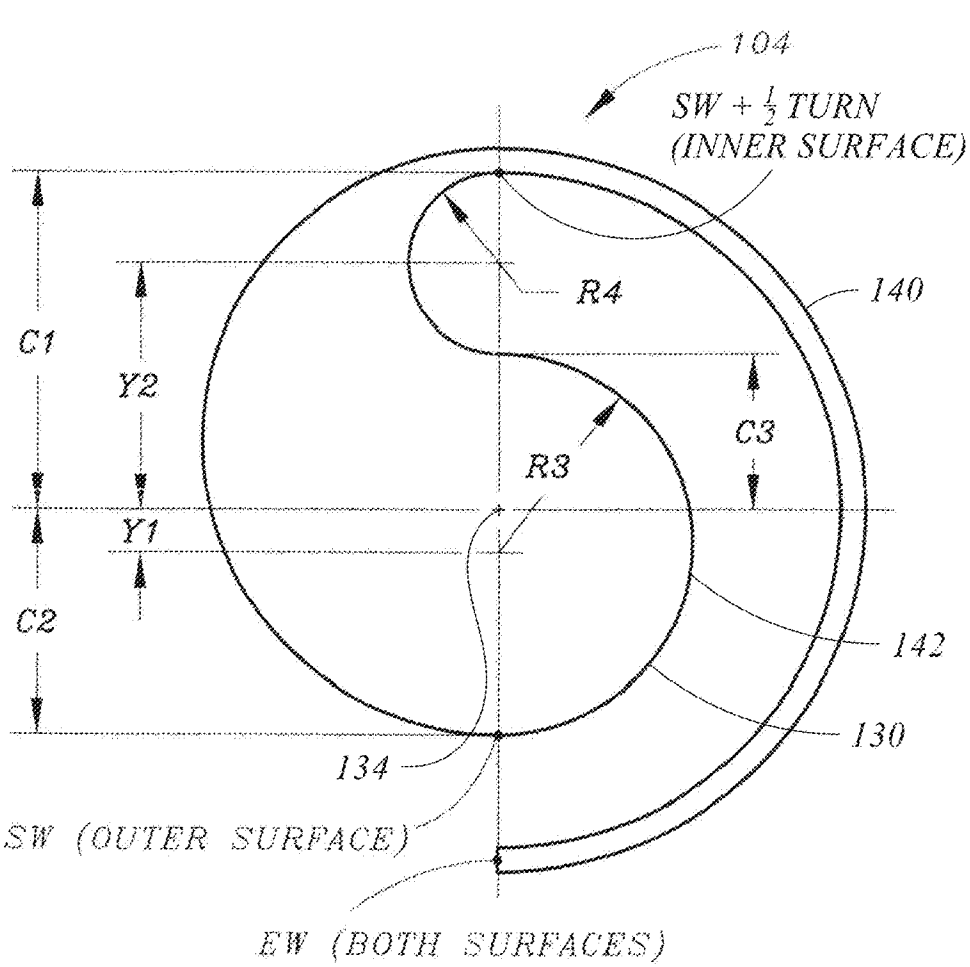
FIG. 14 is a plan view of the orbiting scroll illustrated in FIG. 5, illustrating example geometry.
Figure 13:
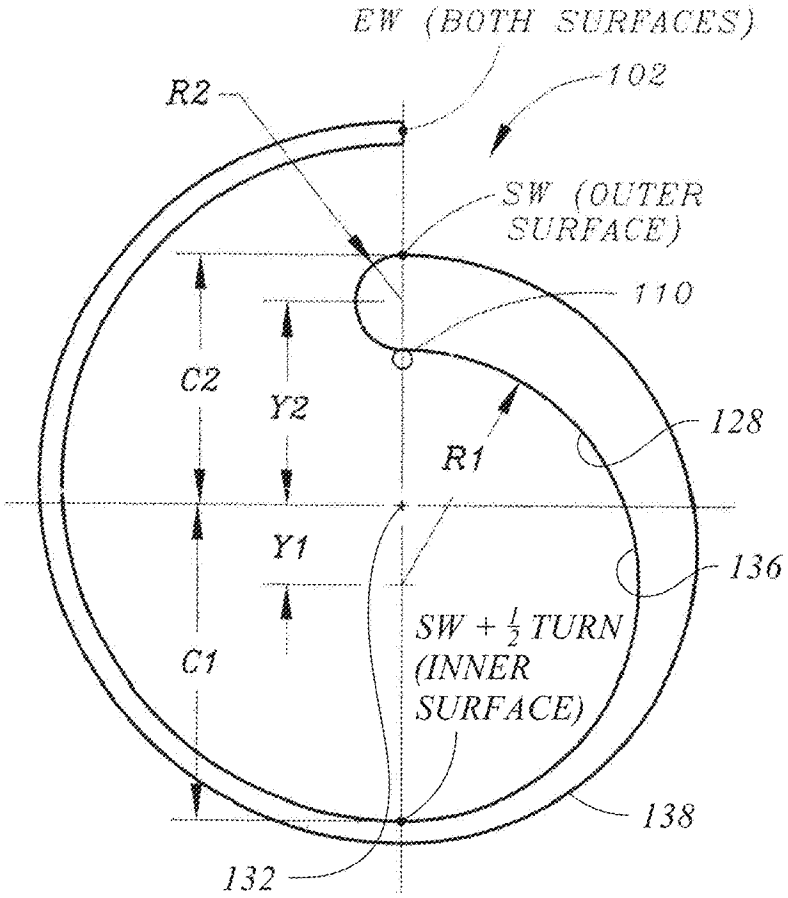
FIG. 13 is a plan view of the fixed scroll illustrated in FIG. 5, illustrating example geometry.

Referring now to FIGS. 13 and 14, for the following discussion, let "SW" equal the starting wrap count. "SW" is the number of turns made from the theoretical center 126 of the scroll before beginning the outer spiral wall surfaces. The inner spiral wall surfaces begin one-half a wrap later, at "SW" plus one-half. Let "W" equal the thickness of the conventional scroll wall outside of the non-conventional constant radius region, let "P" equal the pitch, and let "S" equal the stroke. "P" is the centerline to centerline space between the conventional scroll walls. This is equal to the stroke "S" plus twice the wall thickness "W". "S" is the travel distance of the orbiting scroll in a straight line. This is equal to two times the crankshaft eccentricity. Let "EW"

equal the ending wrap count. "EW" is the number of turns made from the theoretical center 126 of the scroll to the end of the spiral wall surfaces. Similar to conventional scroll design, the ending wrap count may be set as needed to achieve a particular displacement, compression ratio and number of active compression cavities. For example, the embodiments illustrated in FIGS. 15 and 16 exemplify scroll type positive displacement assemblies 100 having two wraps.

Let "C1" equal the distance from the scroll centerline on the fixed scroll to the starting point of the inside wall of the conventional scroll surface. Let "C2" equal the distance from the scroll centerline to the starting point of the outside wall of the conventional scroll surface. Let "C3" equal the distance from the scroll centerline on the orbiting scroll to the starting point of constant radius "R3". "C3" is an independent design variable chosen based on space requirements and design practices. If the central region of the orbiting scroll is enlarged to pass the crankshaft through the center, the value of "C3" is determined by space requirements for the compressor shaft 108, eccentric 106, and eccentric bearing plus minimum wall thickness. "C3" may be reduced for non-thru shaft design. For symmetric scroll geometry, where the orbiting and fixed scroll surfaces are formed as mirror images of each other, let "C3" equal negative "S" divided by four.

Let "R1" equal the constant radius of the beginning inside wall surface 136 one hundred and eighty (180) degree arc of a first wall 128 of the fixed scroll. Let "R2" equal the constant radius of the one hundred and eighty (180) degree arc connecting "R1" to the starting wrap of the outside surface 138 of the conventional scroll wall on the fixed scroll. Let "R3" equal the constant radius of the beginning outside wall surface 140 one hundred and eighty (180) degree arc of a second wall 130 of the orbiting scroll. Finally, let "R4" equal the constant radius of the one hundred and eighty (180) degree arc connecting "R3" to the starting wrap of the inside surface 142 of the conventional scroll wall on the orbiting scroll. Let "Y1" equal the offset from the scroll center 132 which defines the focal point for "R1" on the fixed scroll and the offset from the scroll center 134 which defines the focal point for "R3" on the orbiting scroll. Let "Y2" equal the offset from the scroll center 132 which defines the focal point for "R2" on the fixed scroll and the offset from the scroll center 134 which defines the focal point for "R4" on the orbiting scroll.

Then, example equations for relating the geometrical properties of the fixed and orbiting scrolls 102 and 104 to one another are as follows (it will be appreciated that stroke "S", wall thickness "W", starting wrap count "SW", ending wrap count "EW", and "C3" are independent design variables):

$$P=S+2*W$$

$$C1=(SW+½)*P-W/2$$

$$C2=SW*P+W/2$$

$$Y1=(C2-C3)/2$$

$$Y2=(C1+C3)/2$$

$$R1=C1+(C3-C2)/2$$

$$R2=C2-(C1+C3)/2$$

$$R3=C1+(C3-C2)/2-S/2$$

$$R4=S/2+C2-(C1+C3)/2$$

It should be noted that the scroll type positive displacement assembly 100 may include other dimensional relationships. For example, it will be appreciated that these dimensional relationships describe scroll geometry in a two-dimensional plane. Thus, the depth of the fixed and orbiting scroll members 102 and 104 in a third dimension is another independent design variable which may be chosen based on space requirements and design practices.

Figure 15:
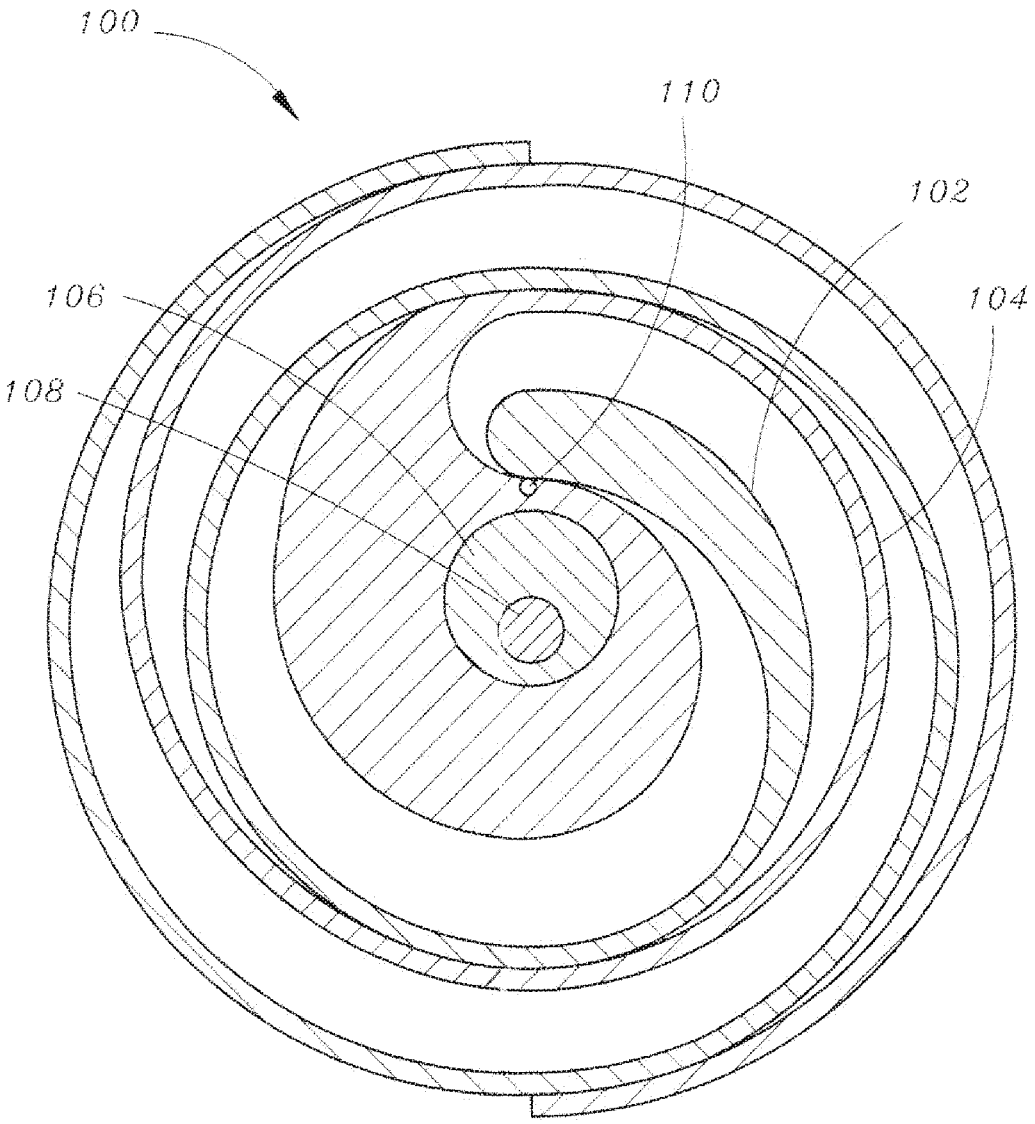
FIG. 15 is a partial cross-sectional plan view illustrating a scroll type positive displacement assembly including a fixed scroll member and an orbiting scroll member, each scroll member having two scroll wraps, in accordance with an example embodiment of the present disclosure.
Figure 16:
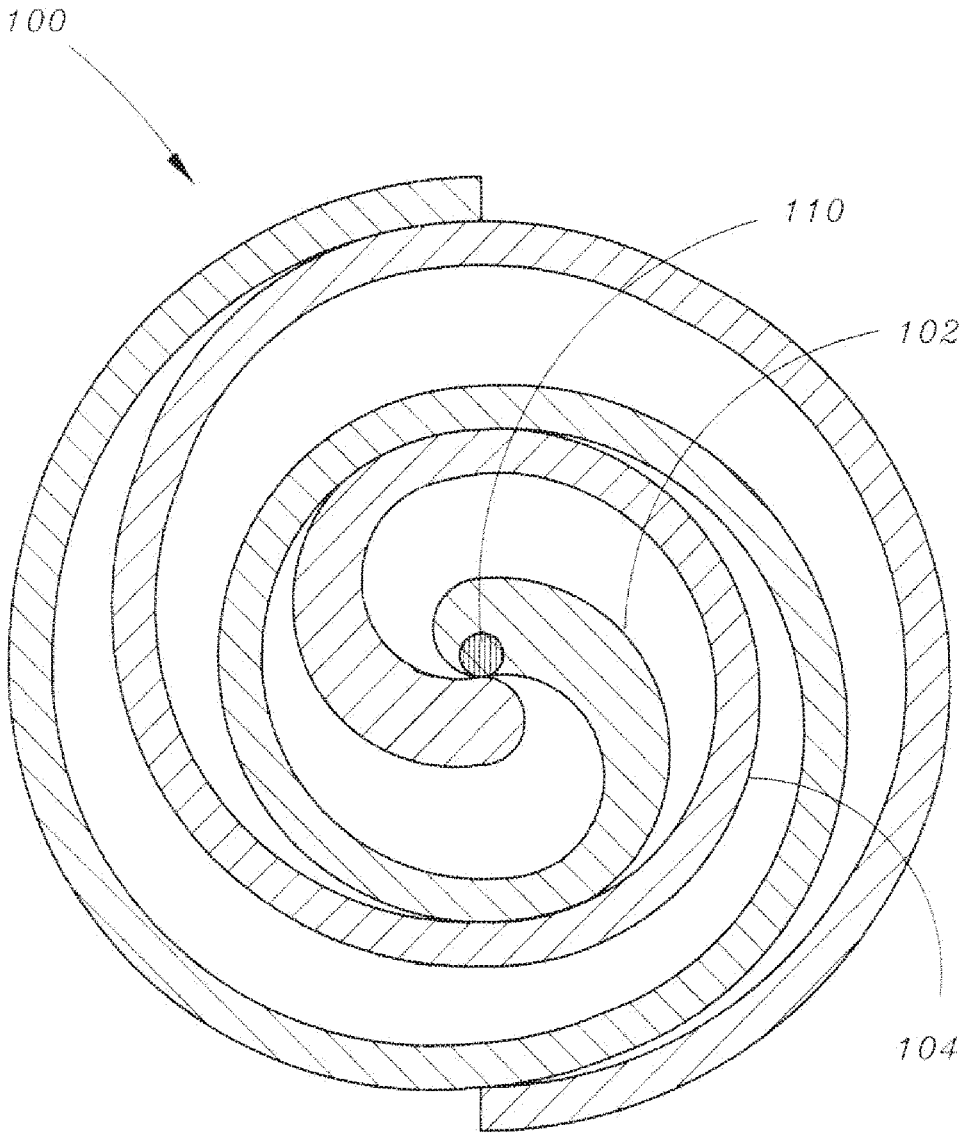
FIG. 16 is a partial cross-sectional plan view illustrating a scroll type positive displacement assembly including a fixed scroll member and an orbiting scroll member, each scroll member having two symmetric scroll wraps, in accordance with an example embodiment of the present disclosure.

It should also be noted that while the scroll type positive displacement assembly 100 illustrated in FIGS. 5 through 14 includes scrolls 102 and 104, each including one wrap (i.e., three hundred and sixty (360) degrees of scroll surface), and the scroll type positive displacement assembly 100 illustrated in FIGS. 15 and 16 includes scrolls 102 and 104, each including two wraps (i.e., seven hundred and twenty (720) degrees of scroll surface), more or fewer wraps may be included with a scroll type positive displacement assembly. For example, more than two (2) scroll wraps may be provided. Further, scroll surfaces extending beyond three hundred and sixty (360) degrees may be defined by conventional scroll equations, e.g., in the same manner as the scroll surfaces extending between one hundred and eighty (180) degrees and three hundred and sixty (360) degrees illustrated in the accompanying figures.

Conventional scroll designs experience seal separation of the innermost cavity seals during the last one hundred and eighty (180) degrees of the compression cycle. This characteristic causes dead space at the end of the compression cycle, which reduces the compression ratio and efficiency of the compressor. In contrast, the inner sealing surface of the fixed scroll of the scroll type positive displacement assembly 100, shown in FIG. 13 as radius "R2", and the adjacent surface on the orbiting scroll, shown in FIG. 14 as radius "R4", are separated during the zero (0) to one hundred and eighty (180) degree crankshaft positions (see FIGS. 5 through 8) and in sealing contact during the one hundred and eighty (180) to three hundred and sixty (360) degree crankshaft positions (see FIGS. 9 through 12). Because these surfaces are in sealing contact during the last one hundred and eighty (180) degrees of the compression cycle, the compression cavity volume is reduced to a theoretical zero (0), leaving no dead space at the end of the compression cycle. This has the effect of increasing compression ratio and compressor efficiency.

Additionally, the center regions of both scrolls of the scroll type positive displacement assembly 100 may be enlarged, moving the discharge port and compression cavities radially outward, without increasing the dead space adjacent to the discharge port at the end of the compression cycle. This feature yields a high compression ratio design with fewer scroll wraps. Enlarging the central region may be done to allow room for the eccentric 106, the eccentric bearing, the shaft 108, and shaft bearings, with the shaft 108 passing through the scrolls and the eccentric 106 and supported by shaft bearings on each side of the eccentric. This feature reduces the radial forces on the shaft bearings allowing the use of smaller bearings and shafting. Further, the eccentric 106 may be located axially within the scroll plane allowing the radial pressure forces between the scrolls to pass through the plane of the eccentric bearing and reducing non-symmetric axial thrust between the scrolls.

Conventional scroll machines require precision machining to match the mating surfaces of the orbiting and stationary scrolls and achieve minimum clearance at the sealing surfaces. As described herein, one or both scroll members of the scroll type positive displacement assembly 100 may be coated with an abradable coating of sufficient thickness to cause interference at all sealing surfaces between the scroll members. During the manufacturing or assembly sequence, the two scroll members can be assembled and operated, causing the excess coating to abrade away, leaving a near-perfect match between the surfaces of both scroll members. This process may reduce the need for precise machining of the scroll members.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A scroll type positive displacement assembly comprising:

a first scroll having a center; and a second scroll configured to orbit with respect to the center of the first scroll without rotating with respect to the first scroll, the first scroll and the second scroll defining a compression chamber between two seal points where the first scroll and the second scroll are in sealing contact with one another as the second scroll orbits with respect to the first scroll during a compression cycle, the two seal points each continuously traveling along a curved path while the first scroll and the second scroll are in sealing contact with one another and coming together at a discharge port between the first scroll and the second scroll such that the compression chamber continuously decreases in volume while the first scroll and the second scroll are in sealing contact with one another.

2. The scroll type positive displacement assembly as recited in claim 1, wherein the two seal points remain in sealing contact during at least one hundred and eighty (180) degrees of the compression cycle.

3. The scroll type positive displacement assembly as recited in claim 1, wherein each one of the first scroll and the second scroll spiral from a first intake cavity and a second intake cavity toward the center of the first scroll and a center of the second scroll so that a first wall of the first scroll and a second wall of the second scroll increase in thickness at the center of the first scroll and the center of the second scroll.

4. The scroll type positive displacement assembly as recited in claim 1, further comprising a shaft passing through the first scroll and the second scroll.

5. The scroll type positive displacement assembly as recited in claim 4, wherein the shaft passes through a bearing in at least one of the first scroll or the second scroll.

6. The scroll type positive displacement assembly as recited in claim 1, wherein the discharge port is offset from a center of the scroll type positive displacement assembly.

7. The scroll type positive displacement assembly as recited in claim 1, wherein at least one of a surface of the first scroll or a surface of the second scroll is abradable to form a match between the surfaces of the first scroll and the second scroll as the second scroll orbits with respect to the first scroll.

8. A scroll type positive displacement assembly comprising:

a first scroll having a first wall surface, a second wall surface, and a center, the first wall surface spaced apart from the second wall surface at a plurality of distances; and a second scroll having a third wall surface, a fourth wall surface, and a center, the third wall surface spaced apart from the fourth wall surface at a plurality of distances, the second scroll configured to orbit with respect to the center of the first scroll without rotating with respect to the first scroll, the first scroll and the second scroll defining a first intake cavity and a second intake cavity, each one of the first scroll and the second scroll spiraling from the first intake cavity and the second intake cavity toward the center of the first scroll and the center of the second scroll so that the pluralities of distances between the first and second wall surfaces and the third and fourth wall surfaces increase at the center of the first scroll and the center of the second scroll, respectively, the first scroll and the second scroll defining a compression chamber between two seal points where the first scroll and the second scroll are in sealing contact with one another as the second scroll orbits with respect to the first scroll during a compression cycle, the two seal points each continuously traveling along a curved path while the first scroll and the second scroll are in sealing contact with one another and coming together at a discharge port between the first scroll and the second scroll such that the compression chamber continuously decreases in volume while the first scroll and the second scroll are in sealing contact with one another.

9. The scroll type positive displacement assembly as recited in claim 8, wherein the two seal points remain in sealing contact during at least one hundred and eighty (180) degrees of the compression cycle.

10. The scroll type positive displacement assembly as recited in claim 8, further comprising a shaft passing through the first scroll and the second scroll.

11. The scroll type positive displacement assembly as recited in claim 10, wherein the shaft passes through a bearing in at least one of the first scroll or the second scroll.

12. The scroll type positive displacement assembly as recited in claim 8, wherein the discharge port is offset from a center of the scroll type positive displacement assembly.

13. The scroll type positive displacement assembly as recited in claim 8, wherein at least one of the first wall surface of the first scroll, the second wall surface of the first scroll, the third wall surface of the second scroll, or the fourth wall surface of the second scroll is abradable to form a match between the wall surfaces of the first scroll and the second scroll as the second scroll orbits with respect to the first scroll.

14. A scroll type positive displacement assembly comprising:

a first scroll having a first wall surface, a second wall surface, and a center, the first wall surface spaced apart from the second wall surface at a plurality of distances; and a second scroll having a third wall surface, a fourth wall surface, and a center, the third wall surface spaced apart from the fourth wall surface at a plurality of distances, the second scroll configured to orbit with respect to the center of the first scroll without rotating with respect to the first scroll, the first scroll and the second scroll defining a compression chamber between two seal points where the first scroll and the second scroll are in sealing contact with one another as the second scroll orbits with respect to the first scroll during a compression cycle, the two seal points each continuously traveling along a curved path while the first scroll and the second scroll are in sealing contact with one another and coming together at a discharge port between the first scroll and the second scroll such that the compression chamber continuously decreases in volume while the first scroll and the second scroll are in sealing contact with one another, the pluralities of distances between the first and second wall surfaces and the third and fourth wall surfaces increasing in thickness at the center of the first scroll and the center of the second scroll, respectively.

15. The scroll type positive displacement assembly as recited in claim 14, wherein the two seal points remain in sealing contact during at least one hundred and eighty (180) degrees of the compression cycle.

16. The scroll type positive displacement assembly as recited in claim 14, further comprising a shaft passing through the first scroll and the second scroll.

17. The scroll type positive displacement assembly as recited in claim 16, wherein the shaft passes through a bearing in at least one of the first scroll or the second scroll.

18. The scroll type positive displacement assembly as recited in claim 17, wherein the bearing comprises an eccentric bearing and the shaft is supported by a shaft bearing on only one side of the eccentric bearing.

19. The scroll type positive displacement assembly as recited in claim 14, wherein the discharge port is offset from a center of the scroll type positive displacement assembly.

20. The scroll type positive displacement assembly as recited in claim 14, wherein at least one of the first wall surface of the first scroll, the second wall surface of the first scroll, the third wall surface of the second scroll, or the fourth wall surface of the second scroll is abradable to form a match between the wall surfaces of the first scroll and the second scroll as the second scroll orbits with respect to the first scroll.

* * * * *